US006713725B2

(12) United States Patent
Izawa et al.

(10) Patent No.: US 6,713,725 B2
(45) Date of Patent: Mar. 30, 2004

(54) IMAGE HEATING APPARATUS

(75) Inventors: Satoru Izawa, Shizuoka (JP); Yuko Tanaka, Kanagawa (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,744

(22) Filed: Mar. 11, 2002

(65) Prior Publication Data

US 2003/0029853 A1 Feb. 13, 2003

(30) Foreign Application Priority Data

Mar. 13, 2001 (JP) ..... 2001-069936
Mar. 7, 2002 (JP) ..... 2002-062142

(51) Int. Cl.[7] ..... G03G 15/20

(52) U.S. Cl. ..... 219/216; 219/539; 399/69; 399/329

(58) Field of Search ..... 219/216, 470, 219/543, 539; 399/69, 328, 329, 334

(56) References Cited

U.S. PATENT DOCUMENTS

| | | | | |
|---|---|---|---|---|
| 4,970,219 A | | 11/1990 | Effland et al. | 514/339 |
| 5,149,941 A | | 9/1992 | Hirabayashi et al. | 219/216 |
| 5,210,579 A | | 5/1993 | Setoriyama et al. | 355/285 |
| 5,525,775 A | | 6/1996 | Setoriyama et al. | 219/216 |
| 5,669,039 A | | 9/1997 | Ohtsuka et al. | 399/68 |
| 5,722,026 A | | 2/1998 | Goto et al. | 399/333 |
| 5,860,051 A | | 1/1999 | Goto et al. | 399/529 |
| 5,862,435 A | | 1/1999 | Suzumi et al. | 399/68 |
| 5,915,146 A | | 6/1999 | Kusaka et al. | 399/68 |
| 5,920,757 A | | 7/1999 | Izawa et al. | 399/329 |
| 5,960,233 A | | 9/1999 | Goto et al. | 399/69 |
| 6,185,383 B1 | * | 2/2001 | Kanari et al. | 219/216 |
| 6,298,213 B1 | | 10/2001 | Miyamoto et al. | 399/320 |
| 6,323,460 B1 | * | 11/2001 | Ohtsuka | 219/216 |
| 6,336,009 B1 | | 1/2002 | Suzumi et al. | 399/67 |
| 6,407,366 B2 | * | 6/2002 | Yoshimura | 219/216 |
| 6,423,941 B1 | * | 7/2002 | Kanari et al. | 219/216 |

FOREIGN PATENT DOCUMENTS

| | | | |
|---|---|---|---|
| JP | 63-313182 | | 12/1988 |
| JP | 02-157878 | | 6/1990 |
| JP | 4-44075 | | 2/1992 |
| JP | 4-204980 | | 7/1992 |
| JP | 2000077168 | * | 3/2000 |
| JP | 2000-162907 | | 6/2000 |
| JP | 2000-162909 | | 6/2000 |
| JP | 2000-235325 | | 8/2000 |
| JP | 2001194936 | * | 7/2001 |

* cited by examiner

*Primary Examiner*—Joseph Pelham
(74) *Attorney, Agent, or Firm*—Fitzpatrick, Cella, Harper & Scinto

(57) ABSTRACT

In the head-fixing apparatus of the film heating system in an image forming apparatus, a heat capacity is controlled to be as small as possible because the quick-start property is recognized to be more importance. Thus, heat conductivity in the longitudinal direction is poor and, due to a relationship between the area where a recording material is conveyed and the heating area of the energizing heating resistance layer, a) heat is insufficient at the end portion in the initial period and b) unusual temperature rising occurs at the end portion at the time of continuous heat-fixing. In order to resolve those problem, an apparatus which can control adequately temperature at the area where a recording material is conveyed without rising temperature at the end portion of a heater as a non-sheet passing area.

24 Claims, 12 Drawing Sheets

TEMPERATURE DISTRIBUTION IN THE HEATER WIDTH DIRECTION OF HEATER, DEPENDING ON POWER SUPPLYING WAYS

IMAGE HEATING APPARATUS

BACKGROUND OF THE INVENTION

1. Field of the Invention

The present invention relates to an image heating apparatus such as a heat-fixing apparatus to be mounted on an image forming apparatus, for example, a copying machine and a printer, and an apparatus for reforming surface property of an image.

2. Related Background Art

As a heat-fixing apparatus that is one type of an image heating apparatus, those of several different systems are put to practical use. One of them is a heat-fixing apparatus of a heat roller system (FIG. 9) represented by a structure that includes a fixing roller 40 provided with a halogen heater 41 inside it and a pressure roller 50 forming a nip N with this fixing roller, nips and conveys a recording material P that bearing an image at the nip, and heats and fixes the image on the recording material. Another one is a heat-fixing apparatus of a film heating system (FIG. 10) represented by a structure that includes a heater 61 provided with a heating resistance layer on a ceramic substrate, a heat resistance film 63 moving while contacting this heater 61 and a pressure roller 53 forming a nip N with the heater 61 via the film 63.

In FIG. 9, reference numeral 44 denotes a thermistor for sensing a temperature of the fixing roller 40. In FIG. 10, reference numeral 64 denotes a thermistor for sensing a temperature of the heater 61 and 62 denotes a holder for holding the heater 61.

In particular, the heat-fixing apparatus of the film heating system has an advantage that a consumption power is small and a print waiting time is short because of a small heat capacity. Thus, the number of models of the image forming apparatus employing this heat-fixing apparatus is increasing.

Such a heat-fixing apparatus of the film heating system is proposed in Japanese Patent Application Laid-Open No. 63-313182, Japanese Patent Application Laid-Open No. 2-157878, Japanese Patent Application Laid-Open No. 4-44075 and Japanese Patent Application Laid-Open No. 4-204980.

Since the heat-fixing apparatus of the film heating system does not require energization of the heater in standby, it is possible to bring the heater to a heatable state by the time when a recording material reaches the heat-fixing apparatus even if the heater is energized after the image forming apparatus receives a print signal. Thus, the heat-fixing apparatus of the film heating system is an excellent heat-fixing apparatus that does not waste energy from the viewpoint of energy savings.

However, the heat-fixing apparatus using a fixing film has a structure in which a heat capacity is controlled as much as possible in order to satisfy quick-start property. Thus, it has poor thermal conductivity in its longitudinal direction and tends to keep a nonuniform temperature distribution. In particular, the heat-fixing apparatus of the film heating system has the following two problems a) and b). Each phenomenon will be described with reference to FIG. 12.

a) Initial Temperature Distribution

If a print operation is started from a state in which a temperature of the heat-fixing apparatus is sufficiently close to a room temperature, since the entire apparatus is cooled, although heat generated by energizing an energizing heating resistance layer of a heater warms a fixing nip portion, the heat is also released to an end portion in the longitudinal direction of the heater. Thus, as shown in FIG. 12, as an initial temperature distribution, a temperature is low at the end portion due to release of heat despite the fact that an uniform temperature distribution is maintained in the vicinity of the central position in the longitudinal direction (in the vicinity of 0 mm of the horizontal axis of the graph).

As a result, there is a problem in that, for example, a fixing performance of an end portion of a wide recording material is inferior to a fixing performance in the vicinity of its center if an unfixed toner image on the recording material is heat-fixed.

In order to avoid this problem, there is a method of enlarging a heating area of the heater to be wider than a width for conveying the recording material or setting a resistance of the energizing heating resistance layer at the end portion to be high to cause the end portion to generate more heat, thereby solving the problem. However, if the width of the energizing heating resistance layer is enlarged, there is another problem in that, for example, the size of the entire apparatus becomes larger.

In addition, if an area sticking out of the conveying area of the recording material is enlarged or a heating amount at the end portion is made larger, sufficient fixing performance is obtained up to the end portion in the initial period after printing is started. However, if toner images are continuously heat-fixed, a problem as described in b) below occurs.

b) Temperature Distribution at Continuous Fixing

Although a heat quantity generated by energizing an energizing heating resistance layer of a heater is given to a recording material via a fixing film, if toner images are continuously heat-fixed, a degree of temperature rising is different between an area where the recording material is conveyed and an area where the recording material is not conveyed.

In other words, in the area where the recording material is conveyed, heat generated in the energizing heating resistance layer is consumed to melt and fix a toner image on the recording material. On the other hand, in the area where the recording material is not conveyed, a pressure roller is directly heated and the heat generated in the energizing heating resistance layer is not consumed by the recording material, heat quantities are gradually accumulated and the end portion in the longitudinal direction where temperature is low in the initial temperature distribution as shown in FIG. 12 is also gradually heated. As a result, as in the temperature distribution at continuous paper feeding in FIG. 12, temperature is unusually raised at the end portion despite the fact that a temperature distribution is substantially fixed in the vicinity of the center of the heater as in the initial period.

In particular, if the energizing heating resistance layer is made longer than the conveying area of the recording material to enlarge the sticking-out area of the energizing heating resistance layer or a resistance distribution is given to the energizing heating resistance layer to increase the heating amount at the end portion, temperature rising at the end portion at the time of continuous heating becomes intense.

Moreover, when power to be consumed in the energizing heating resistance layer increases by speeding up an image forming apparatus, the temperature difference between the conveying area of the recording material and the non-conveying area of the recording material (non-sheet passing area) is more remarkable. That is, since an amount of the recording material capable of being subjected to heat-fixing in a fixed time increases following the speeding-up of an image forming apparatus, more applied power is required.

As a result, particularly in accordance with the speeding-up, temperature rising in the non-sheet passing area becomes large.

The unusual temperature rising in the non-sheet passing area necessitates an improved heat resistance grade of a material in the area and is likely to cause problems such as deterioration of an internal surface of the fixing film and damaged stability of an electrical power supply in an electrode.

As described above, in the heat-fixing apparatus of the film heating system, a heat capacity is controlled to be as small as possible because the quick-start property is recognized to be more importance. Thus, heat conductivity in the longitudinal direction is poor and, due to a relationship between the area where a recording material is conveyed and the heating area of the energizing heating resistance layer, a) heat is insufficient at the end portion in the initial period and b) unusual temperature rising occurs at the end portion at the time of continuous heat-fixing. Thus, means has not been found so far which secures the quick-start property and attains both of the fixing performance at the end portion in the initial period and the prevention of temperature rising of the non-sheet passing area at the time of continuous heat-fixing apparatus. In addition, the above-mentioned problems are obstacles for speeding up the image forming apparatus.

SUMMARY OF THE INVENTION

The present invention has been devised in view of the above-mentioned drawbacks, and it is an object of the present invention to provide an image heating apparatus that can control (restrain) excessive temperature rising in a non-sheet passing area.

It is another object of the present invention to provide an image heating apparatus that can offset an insufficient heat quantity at an end portion thereof in an initial few sheets in continuously heating a plurality of sheets of recording materials.

It is still another object of the present invention is to provide an image heating apparatus, comprising: a heating member; a first heat generating element mounted on the heating member; and a second heat generating element mounted on the heating member, the second heat generating element having a resistance value per unit length at an end portion thereof which is larger than that at an end portion of the first heat generating element, wherein the first heat generating element is located on an upstream side of the second heat generating element in a moving direction of the recording material.

It is still another object of the present invention is to provide an image heating apparatus, comprising: a heating member; a first heat generating element mounted on the heating member, the first heat generating element having a resistance value per unit length which is substantially uniform in a longitudinal direction; and a second heat generating element mounted on the heating member, the second heat generating element having a resistance value per unit length which is nonuniform in the longitudinal direction, wherein the first heat generating element is located on an upstream side of the second heat generating element in a moving direction of the recording material.

It is still another object of the present invention is to provide an image heating apparatus, comprising: a heating member; a first heat generating element mounted on the heating member; and a second heat generating element mounted on the heating member, the second heat generating element being longer than the first heat generating element, wherein the first heat generating element is located on an upstream side of the second heat generating element in a moving direction of the recording material.

It is still another object of the present invention is to provide an image heating apparatus, comprising: a heating member having a heat generating element; and a heat releasing member being capable of contacting with and separating from an end portion of the heating member.

Still another object of the present invention will be apparent from the appended drawings and the following detailed description.

Embodiments of the present invention will be hereinafter described with reference to the accompanying drawings.

DESCRIPTION OF THE PREFERRED EMBODIMENTS

<First Embodiment>

(1) Example of an Image Forming Apparatus

Figure 1:
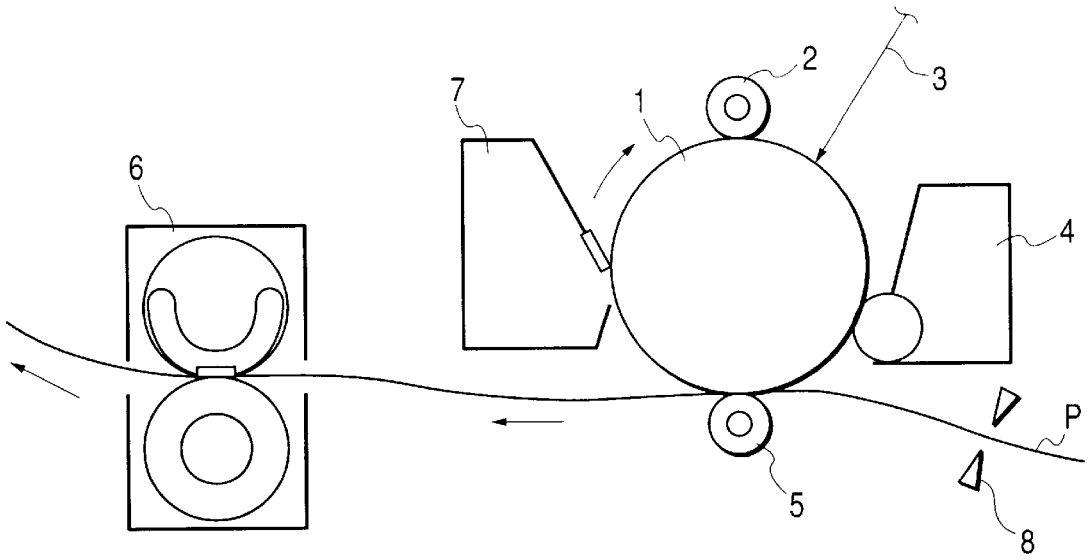
FIG. 1 is a schematic diagram of a printer that is mounted with an image heating apparatus of the present invention.

FIG. 1 shows a schematic diagram of an image forming apparatus in this embodiment.

Reference numeral 1 denotes a photosensitive drum in which a photosensitive material such as OPC, amorphous Se and amorphous Si is formed on a cylindrical substrate of aluminum, nickel or the like.

The photosensitive drum 1 is rotated to be driven in an arrow direction and, first, its surface is uniformly charged by a charging roller 2 functioning as a charging apparatus.

Next, scanning and exposure by a laser beam 3, which is controlled to be turned on and off according to image information, is applied to the photosensitive drum 1 and an electrostatic latent image is formed.

This electrostatic latent image is visualized by a developing apparatus 4. As a developing method, a jumping developing method, a two-component developing method, a FEED developing method and the like are used. Image exposure and reversal developing are often combined to be used.

A visualized toner image is transferred from the photosensitive drum 1 onto a recording material P that is conveyed at predetermined timing. Here, the tip of the recording material P is sensed by a sensor 8 such that a position for forming a toner image on the photosensitive drum 1 and a position for starting writing at the tip of the recording material coincide with each other to take timing. The recording material P conveyed at the predetermined timing is nipped and conveyed at a fixed pressurizing force to the photosensitive drum 1 and the transfer roller 5.

The recording material P on which this toner image is transferred is conveyed to a heat-fixing apparatus 6 and the toner image is fixed as a permanent image.

On the other hand, transfer residual toner remaining on the photosensitive drum 1 is removed from the surface of the photosensitive drum 1 by a cleaning apparatus 7.

(2) Heating and Fixing Apparatus 6

Figure 2:
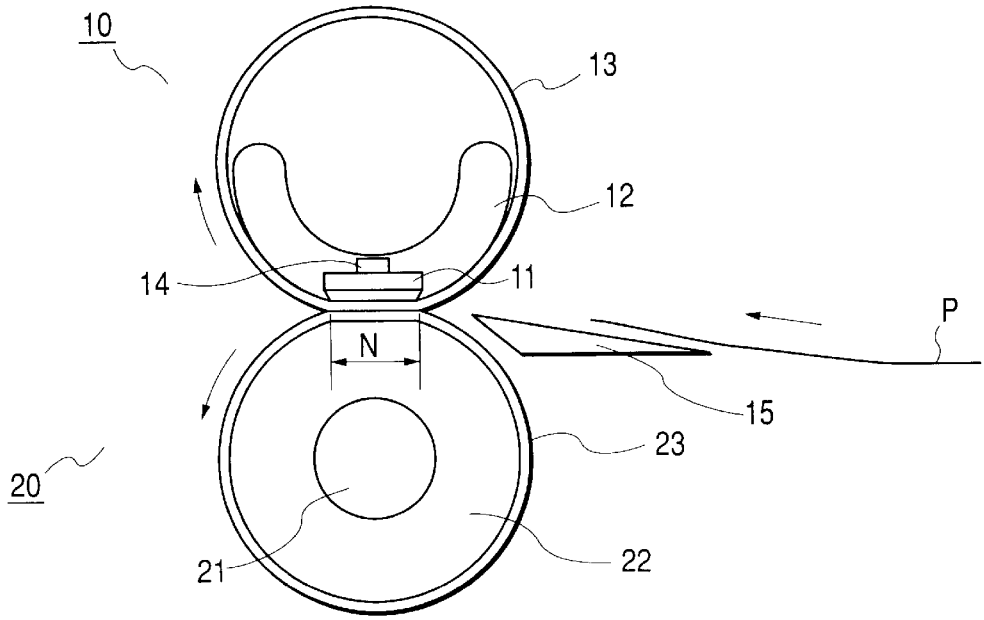
FIG. 2 is a schematic diagram (schematic horizontal sectional view) of a heat-fixing apparatus.
Figure 3:
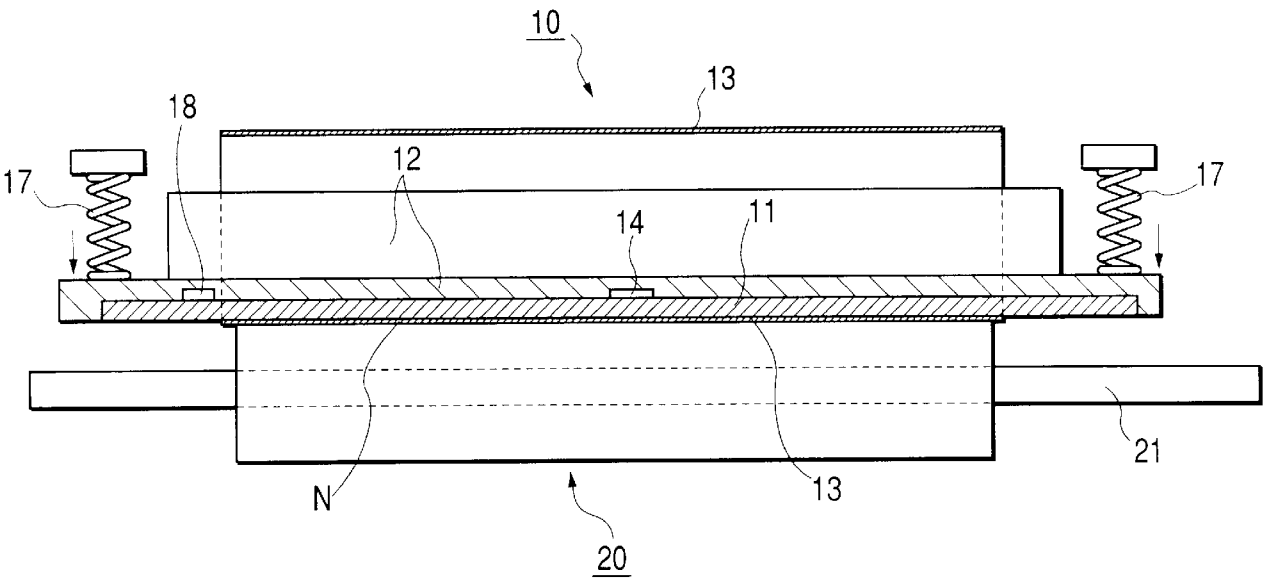
FIG. 3 is a schematic diagram (schematic vertical sectional view) of the heat-fixing apparatus.
Figure 10:
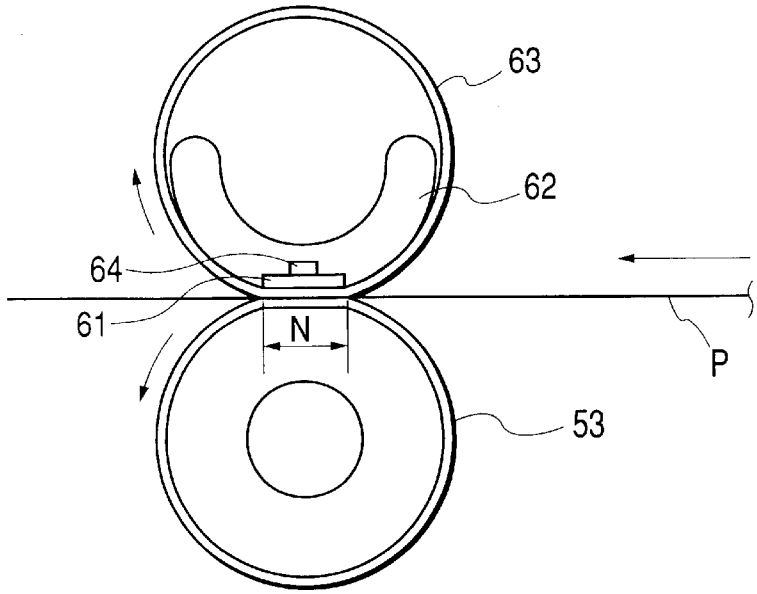
FIG. 10 is a schematic diagram of a heat-fixing-apparatus (film heating system) of the conventional example.
Figure 11:
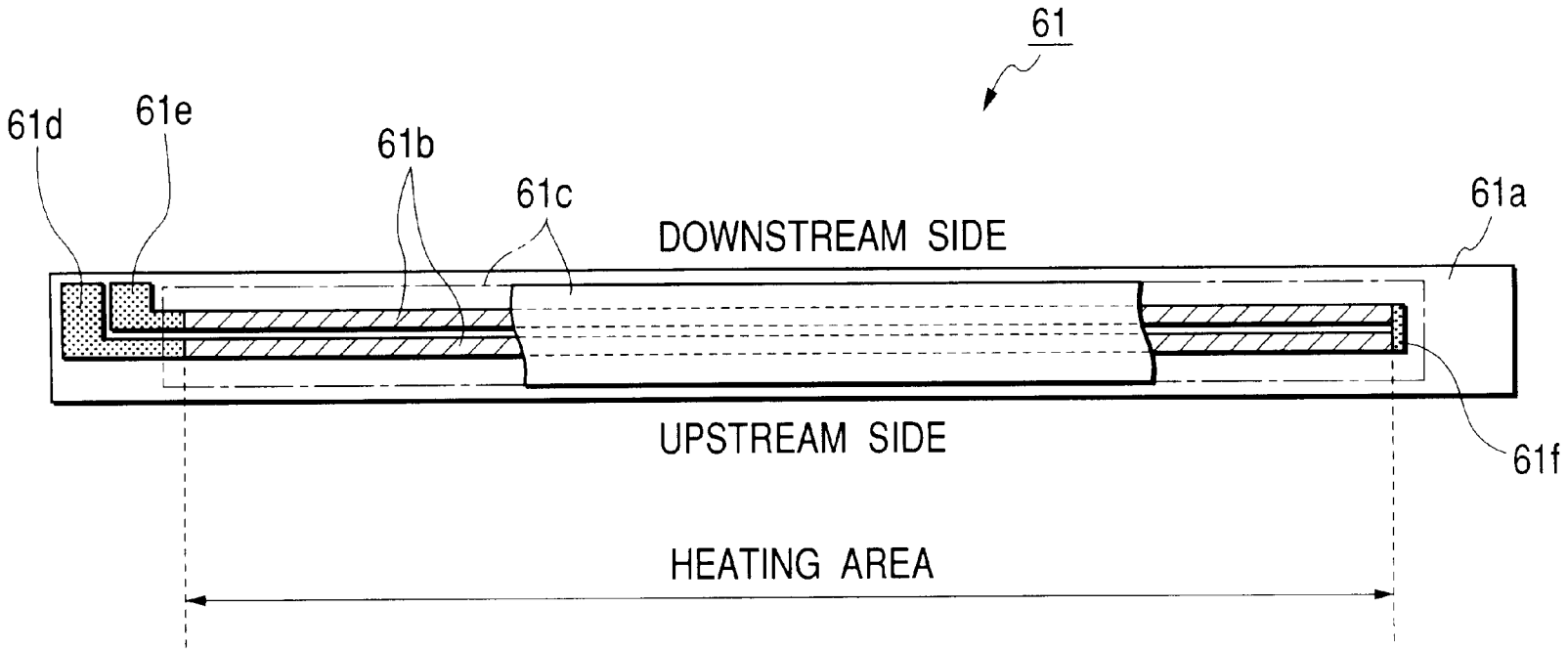
FIG. 11 is a schematic diagram of a heater in accordance with the conventional example.

FIG. 2 and FIG. 3 show a structure of the heat-fixing apparatus 6 of this embodiment. FIG. 2 is a schematic horizontal sectional view and FIG. 3 is a schematic vertical view of the heat-fixing apparatus 6. The heat-fixing apparatus 6 is basically the same as the heat-fixing apparatus of the pressure roller driving system and the film heating system of FIG. 10 described above.

Reference numeral 10 denotes a fixing member, which is constituted by members such as a fixing film 13, a heater 11 and a heat insulating stay holder 12. Reference numeral 20 denotes an elastic pressure roller functioning as a pressurizing member.

A predetermined pressurizing force is given to the part between the heater 11 and the pressure roller 20 by a pressure spring 17 from the end portion of the heat insulating stay holder 12 holding the heater 11 of the fixing member 10. Thus, a fixing nip portion N for heating and melting a toner image of a recording material is formed. In addition, a temperature sensing element 14 such as a thermistor is disposed on the back of the heater 11 in an area where the recording material is conveyed in the vicinity of the center of the fixing nip portion N regardless of the size of the recording material. The temperature sensing element 14 carries out temperature control of the heater 11.

A. Fixing film 13

The fixing film 13 is a film member with a small heat capacity and is a heat resistant film having a total thickness of 100 $\mu$m or less in order to allow quick start. A heat resistant resin such as polyimide, polyamide and PEEK or a metal material such as SUS, Al, Ni, Ti and Zn having a heat resistance and high thermal conductivity is used individually or in combination to form a base layer. In a case of a base layer made of resin, high thermal conductive powder such as Bn, alumina and Al may be mixed in order to improve the heat conductivity. In addition, the total thickness of 20 $\mu$m or more is required as a base layer excellent in durability which has sufficient strength in order to form the fixing film 13 of long durable life. Thus, the size of 20 $\mu$m or more and 100 $\mu$m or less is optimal as the total thickness of the fixing film 13.

Moreover, in order to secure offset prevention and separability of a recording material, fluorocarbon resin such as polytetrafluoroethylene (PTFE), tetrafluoroethylene perfluoroalkyl vinyl ether copolymer (PFA), tetrafluoroethylene hexafluoropropylene copolymer (FEP), ethylene tetrafluoroethylene copolymer (ETFE), polychlorotrifluoroethylene (CTFE) and polyvinylidenefluoride (PVDF) and heat resistant resin with good releasing property such as silicone resin are used for coating on a surface layer of the fixing film 13 mixedly or individually as a releasing layer.

As a method of coating, a method of dipping a releasing layer or applying powder spray or the like after etching processing of an external surface of the base layer or a method of covering a layer formed in a tube shape over the surface of the base layer may be used. Alternatively, a method of applying a primer layer functioning as adhesive on the external surface of the base layer and coating a releasing layer on it may be used.

In addition, a fluorocarbon resin layer or the like with high lubricity may be formed on the internal surface of the fixing film 13 that contacts the heater.

B. Heater 11

The heater 11 is provided inside the fixing film 13 formed with the base layer of the fixing film as a base material. The heater 11 contacts the internal surface of the fixing film 13 in the fixing nip portion N, whereby a nip portion is heated which melts and fixes a toner image on the recording material P conveyed to the fixing nip portion N. Details of portions in the vicinity of the heater 11 and the fixing nip portion N in accordance with the present invention will be described in section (3) below.

C. Heat Insulating Stay Holder 12

The heat insulating stay holder 12 is a member for holding the heater 11 and preventing release of heat in the direction opposite the nip portion N and is formed of heat resistant resin such as liquid crystal polymer, phenol resin, PPS and PEEK. The fixing film 13 is externally fit loosely on the heat insulating stay holder 12 with an allowance and is rotatably disposed in an arrow direction.

In addition, since the fixing film 13 rotates while rubbing against the heater 11 and the heat insulating stay holder 12 inside it, it is necessary to control a frictional resistance between the heater 11 and the fixing film 13 as well as the heat insulating stay holder 12 and the fixing film 13. For this purpose, a small amount of lubricant such as heat resistant grease is applied to the surfaces of the heater 11 and the heat insulating stay holder 12. Consequently, the fixing film 13 can rotate smoothly.

D. Pressure Roller 20

The pressure roller 20 functioning as pressurizing member consists of an elastic layer 22 formed outside a metal core 21 such as SUS, SUM or Al by foaming heat resistant rubber such as silicon rubber or fluorocarbon rubber. A releasing layer 23 of PFA, PTFE, FEP or the like may be formed on the elastic layer 22.

The pressure roller 20 is sufficiently pressurized by pressurizing means 17 in the direction of the fixing member 10 from its both end portions in the longitudinal direction in order to form the nip portion N that is necessary for heat-fixing apparatus. In addition, the pressure roller 20 is rotated to be driven by not-shown driving means from the end portion in the longitudinal direction of the meal core 21 of the pressure roller 20.

As a result, the fixing film 13, which is externally fit loosely on the circumference surface of the heat insulating stay holder 12 with an allowance, is driven and rotated with a frictional force by the circumference surface of the pressure roller 20.

The structure of the heat-fixing apparatus 6 is as described above. The recording material P is appropriately supplied by not-shown supplying means and is conveyed into the fixing nip portion N, which is formed by the heating member 10 and the pressurizing member 20, along a heat resistant fixing entrance guide 15. Thereafter, the recording material P discharged from the fixing nip portion N is guided by a not-shown heat resistant fixing and discharging guide to be discharged onto a not-shown discharge tray.

(3) Heater 11

Figure 4:
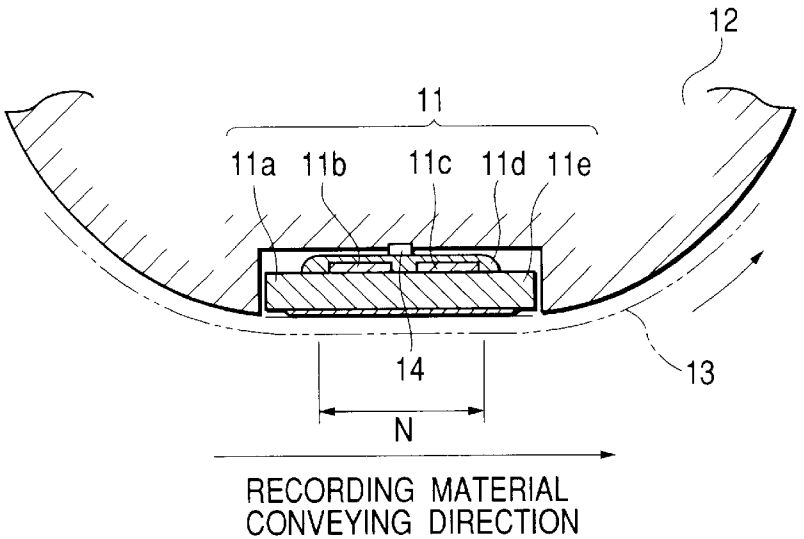
FIG. 4 is a schematic diagram (schematic horizontal sectional view) of a heater.

Here, detailed structure of portions in the vicinity of the heater 11 and the fixing nip portion N in accordance with the present invention will be described with reference to FIG. 4 and FIG. 5.

The heater 11 of this embodiment has a structure of a backside heating type. That is, symbol 11*a* denotes a high thermal conductive substrate that is formed of a ceramic material such as alumina or AlN. The width of the high thermal conductive substrate 11*a* is formed larger than the width of the fixing nip portion N that is formed between the high thermal conductive substrate 11*a* and the pressure roller 20.

In addition, at least two lines of an energizing heating resistance layer 11*b* and an energizing heating resistance layer 11*c* consisting of conductive agent such as Ag/Pd (silver palladium), Ni/Cr, $RuO_2$, $Ta_2N$ or $TaSiO_2$ and a matrix component such as glass or polyimide are coated and formed in a line shape or a thin band shape and a bow shape with the thickness of approximately 10 $\mu$m and the width of approximately 1 to 5 mm by screen printing, evaporation, sputtering, plating, metal leaf or the like on the opposite side of the fixing nip portion N of the high thermal conductive substrate 11*a* along its longitudinal direction.

In addition, an insulating protective layer lid of heat resistant polyimide, polyamide imide, PEEK, glass or the like is formed on the energizing heating resistance layers 11*b* and 11*c*.

Further, in the part on the fixing nip portion N side where the high thermal conductive substrate 11*a* rubs against the fixing film 13, a sliding layer 11*e* may be provided, which is formed by individually or mixedly coating fluorocarbon resin such as polytetrafluoroethylene (PTFE), tetrafluoroethylene perfluoroalkyl vinyl ether copolymer (PFA), tetrafluoroethylene hexafluoropropylene copolymer (FEP), ethylene tetrafluoroethylene copolymer (ETFE), polychlorotrifluoroethylene (CTFE) and polyvinylidenefluoride (PVDF) or thinly applying or depositing dry film lubricant, glass, diamond like carbon (DLC) or the like consisting of graphite, molybdenum disulfide or the like.

Consequently, the fixing film 13 and the heater 11 are allowed to slide smoothly with a low frictional coefficient.

Alternatively, the heater 11 may be structured such that surface roughness of a surface of the high thermal conductive substrate 11*a* where it slides with the fixing film 13 is controlled to be a predetermined value or less and slidability is secured by lubricity grease or the like to control a thermal resistance low, thereby improving the thermal efficiency.

The opposite side of the nip side of the heater 11 formed as described above, that is, the side where the energizing heating resistance layers 11*b* and 11*c* are formed is adhered to the heat insulating stay holder 12 or pressed by a not-shown holding member.

In addition, the temperature sensing element 14 such as a thermistor for sensing a temperature of the heater 11, which is warmed according to heating of the energizing heating resistance layer 11*b* and the energizing heating resistance layer 11*c*, is disposed on the side of the energizing heating resistance layer 11*b* and the side of the energizing heating resistance layer 11*c* of the heater 11 such that the temperature sensing element 14 comes to be in pressured contact with the heater with a predetermined pressurizing force.

A duty ratio, a wave number and the like of a voltage applied to the energizing heating resistance layer 11*b* and the energizing heating resistance layer 11*c* from an electrode portion 11*f*, an electrode portion 11*g* and an electrode portion 11*h* discussed below located at the end portion in the longitudinal direction are appropriately controlled according to a signal of this temperature sensing element 14, whereby an adjusted temperature in the fixing nip portion N is kept substantially constant and heating required for fixing a toner image on the recording material P is carried out. That is, energization of the energizing heating resistance layer 11*b* and the energizing heating resistance layer 11*c* is controlled such that a sensed temperature of the temperature sensing element 14 maintains a target temperature.

Figure 5:
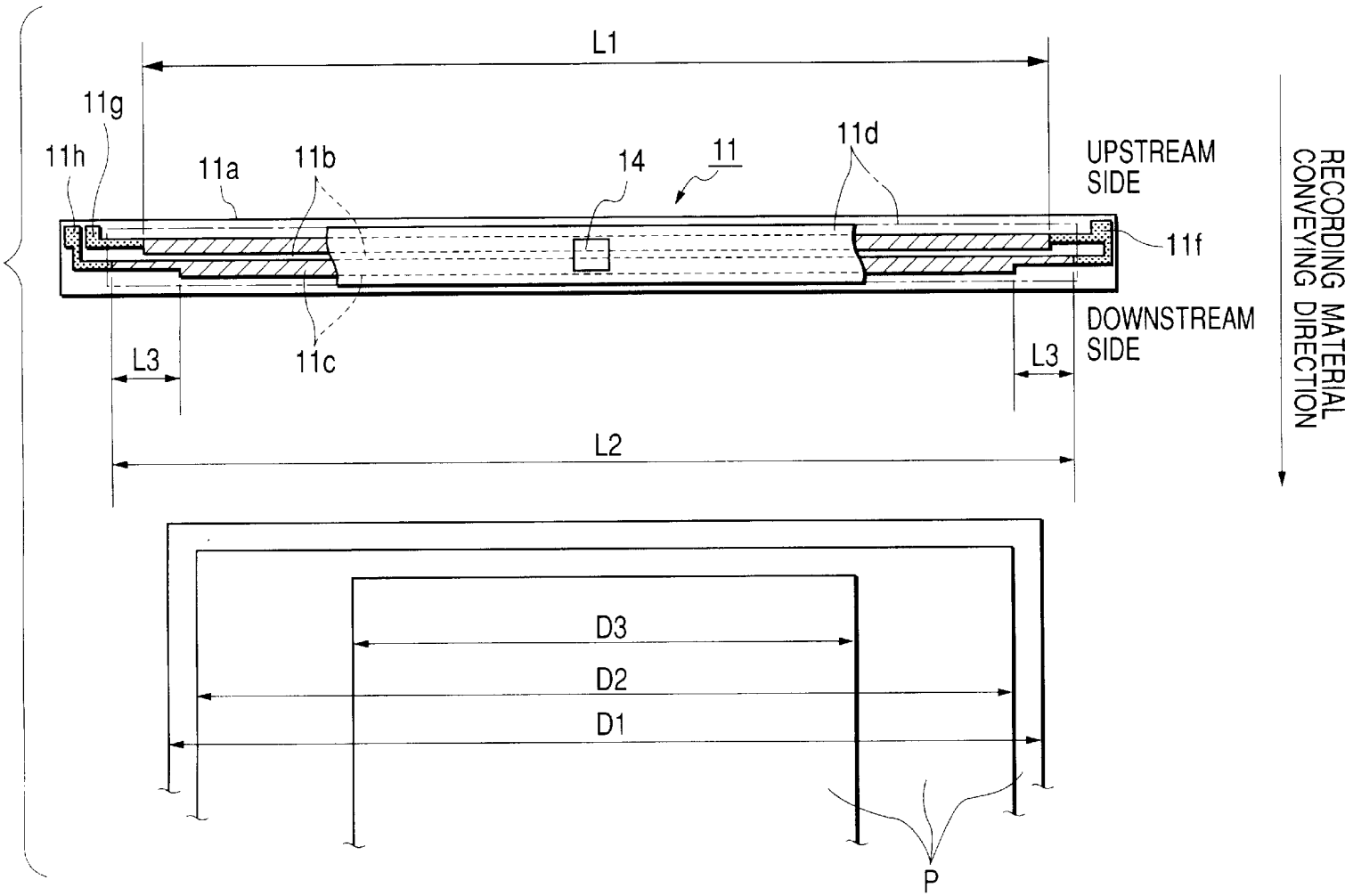
FIG. 5 is a schematic diagram (partially cut-off backside view) of the heater.

In FIG. 5, the energizing heating resistance layer 11*b* and the energizing heating resistance layer 11*c* formed on the high thermal conductive substrate 11*a* are formed with a length L1 and a length L2, respectively. Each of the energizing heating resistance layer 11*b* and the energizing heating resistance layer 11*c* is supplied power from not-shown power sources and generates heat independently through the electrode portion 11*f*, the electrode portion 11*g* and the electrode portion 11*h*.

That is, the energizing heating resistance layer 11*b* generates heat by an electrical power supply between the electrode portion 11*f* and the electrode portion 11*g* and the energizing heating resistance layer 11*c* generates heat by an electrical power supply between the electrode portion 11*f* and the electrode portion 11*h*.

In addition, since the not-shown power source for an electrical power supply to each of the energizing heating resistance layer 11*b* and the energizing heating resistance layer 11*c* are independent from each other, an energizing duty of the energizing heating resistance layer 11*b* and the energizing heating resistance layer 11*c* can be fluctuated.

Further, in the energizing heating resistance layer 11*b* and the energizing heating resistance layer 11*c*, the energizing heating resistance layer 11*c* disposed on the downstream side in the conveying direction of a recording material is formed such that it has a nonuniform distribution of resistance values in the longitudinal direction and a resistance value per unit length at the end portion is higher than that at the central portion. A distribution of resistance values of the energizing heating resistance layer 11*b* is uniform over the longitudinal direction.

That is, the width of the energizing heating resistance layer 11*c* of the identical paste is reduced over the length of L3 at the both end portions of the length L2 in the energizing heating resistance layer 11*c* of FIG. 5, whereby a resistance value per unit length over the length L3 is set higher than that in the vicinity of the center of the conductive heating conductive layer 11*c*. Consequently, the resistance value per unit length at the end portion of the energizing heating resistance layer 11*c* is larger than the resistance value per unit length at the end portion of the energizing heating resistance layer 11*b*. In addition, the energizing heating resistance layer 11*c* is longer than the energizing heating resistance layer 11*b*.

Further, although a resistance value per unit length is changed by changing the width of the energizing heating resistance layer 11*c* in FIG. 5, it is needless to mention that a distribution of resistance values may be given by changing paste.

In addition, in FIG. 5, the energizing heating resistance layer 11*b* is formed with a substantially equivalent length with respect to a maximum conveying width D1 of the recording material P and the energizing heating resistance layer 11*c* is formed to be slightly longer than the maximum conveying width D1.

The temperature sensing element 14 such as a thermistor is disposed in the back of the heater 11 in the area where the recording material P is conveyed in the vicinity of the center regardless of the size of the recording material P and controls a temperature of the heater 11.

With the above-mentioned structure, a temperature distribution of the heater 11 is measured. A structure used for the experiment is as described below.

First, as a basic structure, the heater 11 used a high thermal conductive AlN substrate with a width of 10 mm as its substrate 11*a*. The heater 11 also used layers of a mixture of and conductive agent of Ag/Pd phosphoric acid-based glass as a matrix component, which is mixed with organic solvent, binder, dispersing agent and the like to be paste-like, screen printed and baked at 600° C. as the energizing heating resistance layer 11*b* and the energizing heating resistance layer 11*c* on the opposite side of the fixing nip portion N on the AlN substrate. The energizing heating resistance layer 11*b* and the energizing heating resistance layer 11*c* are formed in two lines as shown in FIG. 4 and FIG. 5. One line is formed with the width L1=216 mm in which a resistance value per unit length is identical over the longitudinal direction. The other line is formed with the length L2=222 mm and a resistance value per unit length over a length L3=20 mm on both the end portions to be 140% with respect to a resistance value per unit length in the vicinity of the center. In addition, phosphorous acid-based glass was formed by screen printing with a thickness of 10 μm as the sliding layer 11*e* on the fixing nip portion N side of the AlN substrate 11*a*.

In addition, the energizing heating resistance layer 11*b* and the energizing heating resistance layer 11*c* are formed such that a ratio of resistance values of the layers is 2:3. As a result, the energizing heating resistance layer 11*b* and the energizing heating resistance layer 11*c* are formed such that, if they were energized at equivalent energizing duty ratios, a ratio of a heating amount by the energizing heating resistance layer 11*b* on the upstream side and a heating amount by the energizing heating resistance layer 11*c* on the downstream side is 3:2.

In addition, the fixing film 13 is formed in a cylindrical shape with an external diameter of 24.13 mm by applying a primer layer of 5 μm and PFA resin of 10 μm to cylindrical seamless polyimide having an internal diameter of 24 mm and a thickness of 50 μm by dipping.

Further, the pressure roller 20 is formed of a silicon rubber layer with a thickness of 5 mm over an Al core 20 mm and further coated with a PFA tube over an external layer.

In the experiment, a speed for conveying a recording material of the image forming apparatus was set to be 200 mm/sec. An energizing duty of each of the energizing heating resistance layer 11*b* and the energizing heating resistance layer 11*c* is changed as shown in the table below according to the number of recording materials P, which are subjected to continuous heat-fixing, to measure a temperature distribution of the heater 11.

Further, the energizing duty in the table is shown as an energizing duty of the energizing heating resistance layer 11*c* as opposed to an energizing duty of the energizing heating resistance layer 11*b* having an equivalent resistance value per unit length over the longitudinal direction. That is, the larger the ratio, the higher a degree of energizing the energizing heating resistance layer 11*c* that consumes more power at the end portion. Thus, a heating amount at both the end portions in the longitudinal direction of the heater 11 increases.

In addition, the heat-fixed recording material P is a thick cut sheet with a thickness of 200 μm having a width of D2 that is slightly narrower than a maximum conveying width D1 as shown in FIG. 5. 500 cut sheets are subjected to continuous heat-fixing.

TABLE 1

| | Number of sheets fed | | | |
|---|---|---|---|---|
| | 1 to 40 sheets | 41 to 100 sheets | 101 to 200 sheets | 201 sheets or more |
| Energizing duty (11c/11b) | 120% | 80% | 50% | 20% |

Figure 6A:
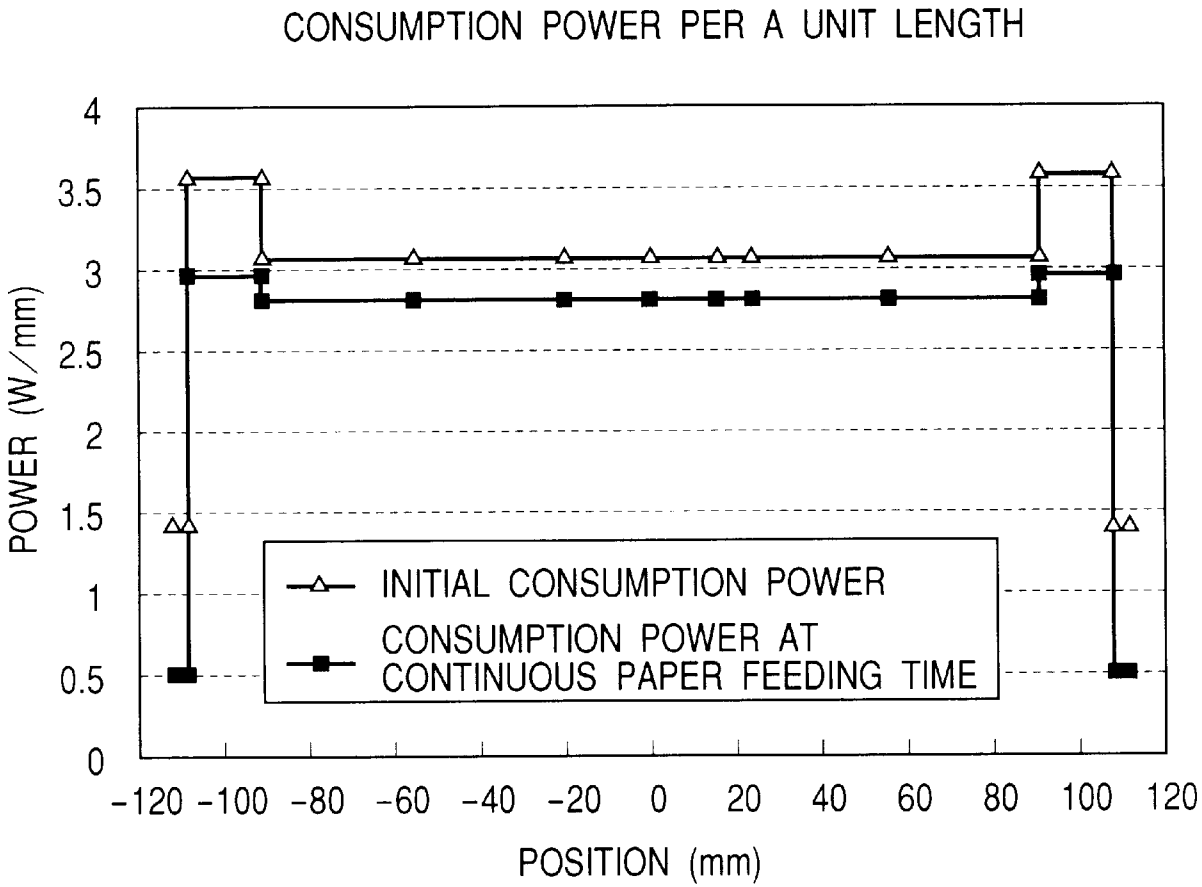
FIG. 6A is a graph showing a consumption power distribution in a longitudinal direction of the heater.
Figure 6B:
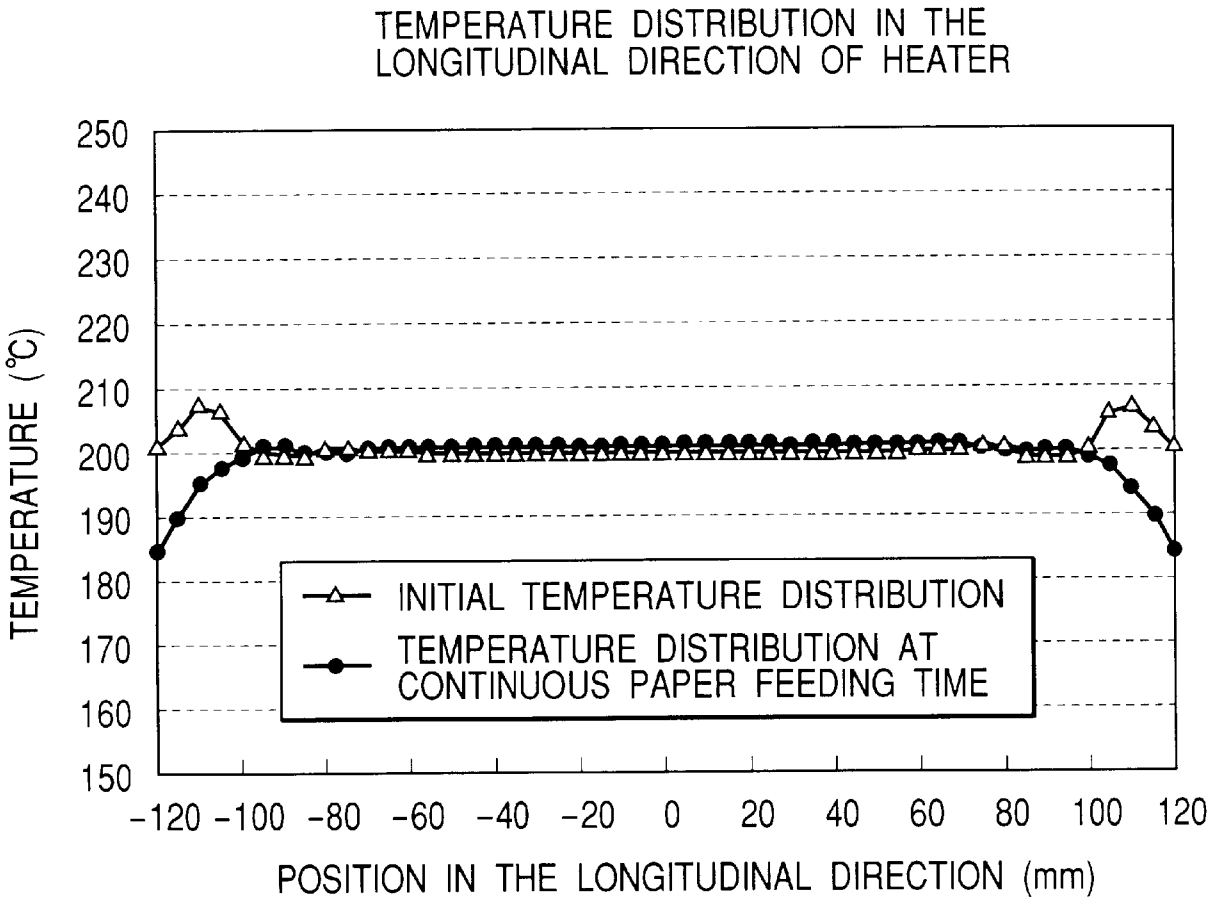
FIG. 6B is a graph showing a temperature distribution in the longitudinal direction of the heater.

FIG. 6A and FIG. 6B show results of measuring a consumption power distribution, that is, a consumption power distribution of the energizing heating resistance layer 11*b* and energizing heating resistance layer 11*c* in combination, and a temperature distribution in the longitudinal direction of the heater 11 in the case in which the recording materials P are subjected to continuous heat-fixing with the above energizing duties.

In FIG. 6A, the horizontal axis shows a position in the longitudinal direction of the heater 11. A sum of consumed power per unit length is shown on the vertical axis with respect to each heater in positions at 108 mm to the left and 111 mm to the right, respectively, with the center of a recording material conveying reference as 0 mm. From the results shown in the figure, it is seen that, since the energizing duty of a heater having a large heating amount at the end portion is high at the initial period, consumption power is large at the end portion. On the other hand, with consumption power at continuous sheet feeding time (when 500 pieces are fed), the heater is energized such that consumption power at the end portion is slightly larger than that in the central portion.

In addition, a temperature distribution of the heater 11 at this point is shown in FIG. 6B. The horizontal axis shows a position in the longitudinal direction of the heater 11. Temperatures shown in this figure were measured by a thermocouple up to 120 mm at an interval of 5 mm to the left and the right, respectively, with the center of the recording material conveying reference as 0 mm. Further, the vertical axis shows a measured temperature in each measurement point. An initial temperature distribution in the graph is a temperature distribution at the time when a first cut sheet is fed into the heat-fixing apparatus. On the other hand, a temperature distribution at continuous sheet feeding time is a temperature distribution at the time when a 500th cut sheet is fed into the heat-fixing apparatus.

Figure 12:
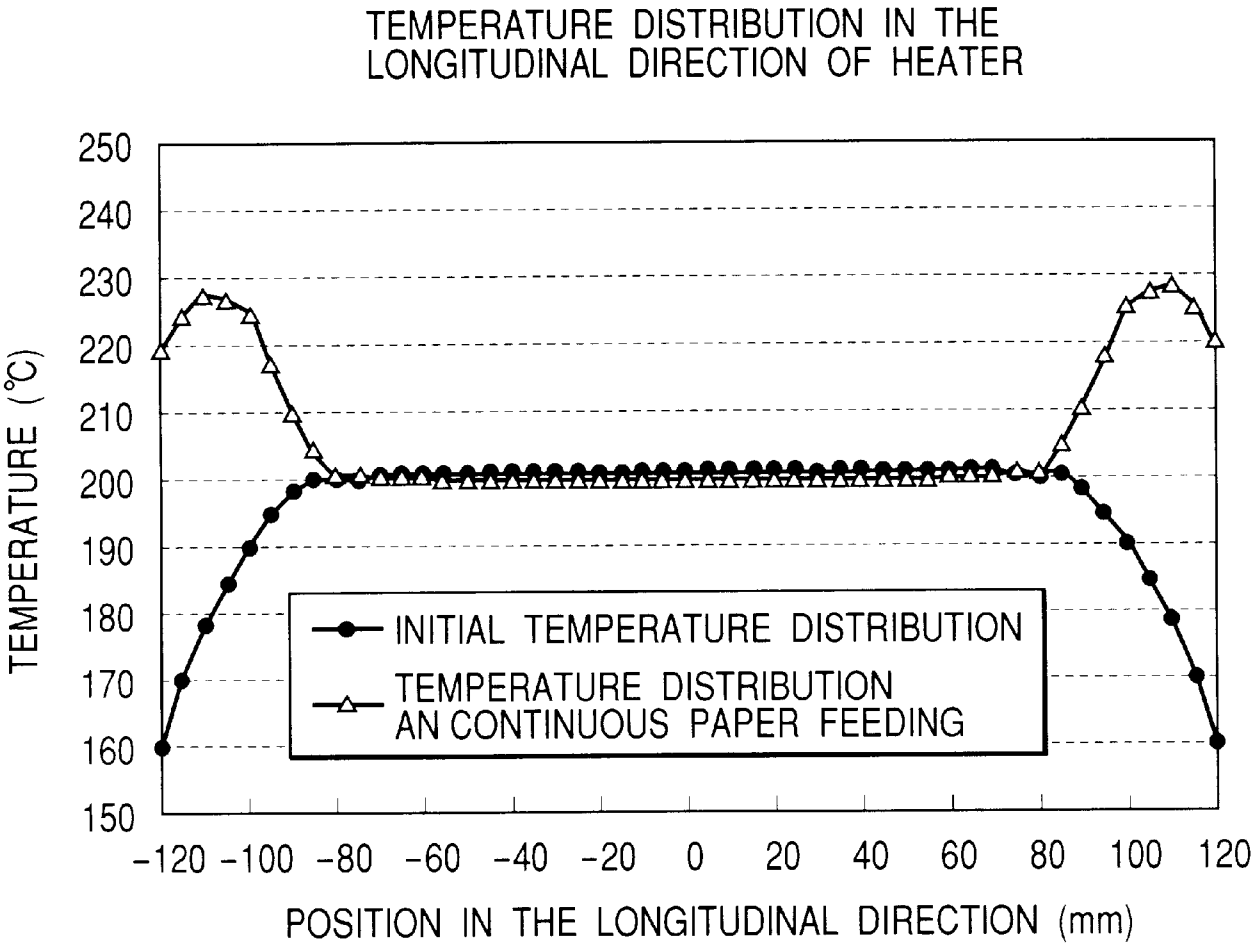
FIG. 12 is a graph showing a temperature distribution in a longitudinal direction of the heater in accordance with the conventional example.

From the figure, it is seen that, although a temperature at the end portion in the longitudinal direction fell slightly, a substantially uniform temperature distribution is kept and the end portion fixing performance was sufficient as well in the initial temperature distribution. In the temperature distribution at continuous sheet feeding time, temperature rising in an area where a cut sheet does not pass is controlled to be a degree that does not cause a problem. In particular, when compared with FIG. 12 of the conventional example, effects are remarkable. Thus, it becomes possible to provide a heat-fixing apparatus that attains both the securing of the initial end portion fixing performance, which is concerned following speed-up of an image forming apparatus, and the prevention of unusual end portion temperature rising at the time of continues heat-fixing apparatus.

In addition, although uniformity of a temperature distribution in the longitudinal direction is realized in the above by changing an energizing duty of each of the energizing heating resistance layer 11*b* and the energizing heating resistance layer 11*c* according to the number of recording materials P, the same effects can be obtained by a method described below.

That is, in FIG. 3, a temperature at the end portion of the heater 11 is monitored by a second temperature sensing element 18 such as a thermistor provided in the back at the end portion of the heater 11. Energizing duties of the two lines of the energizing heating resistance layer 11*b* and the energizing heating resistance layer 11*c* shown in FIG. 4 and FIG. 5 are changed according to this temperature. That is, judging from a difference of temperatures in the first temperature sensing element 14 in the vicinity of the center of the heater 11 and the second temperature sensing element 18 disposed at the end portion of the heater 11, if the temperature at the end portion of the heater 11 is lower, an energizing duty of the energizing heating resistance layer 11*c*, in which a heating amount at the end portion is high, is increased. On the other hand, if the temperature at the end portion is higher, an energizing duty of the energizing heating resistance layer 11*c*, in which a heating amount at the end portion is high, is lowered such that the temperature at the end portion is controlled to be a predetermined temperature or less. Consequently, since the temperature at the end portion of the heater is directly detected, it becomes possible to secure the initial end portion fixing performance and surely avoid the end portion of the heater 11 resulting in unusual temperature rising at the time of continuous heat-fixing apparatus.

Figure 13:
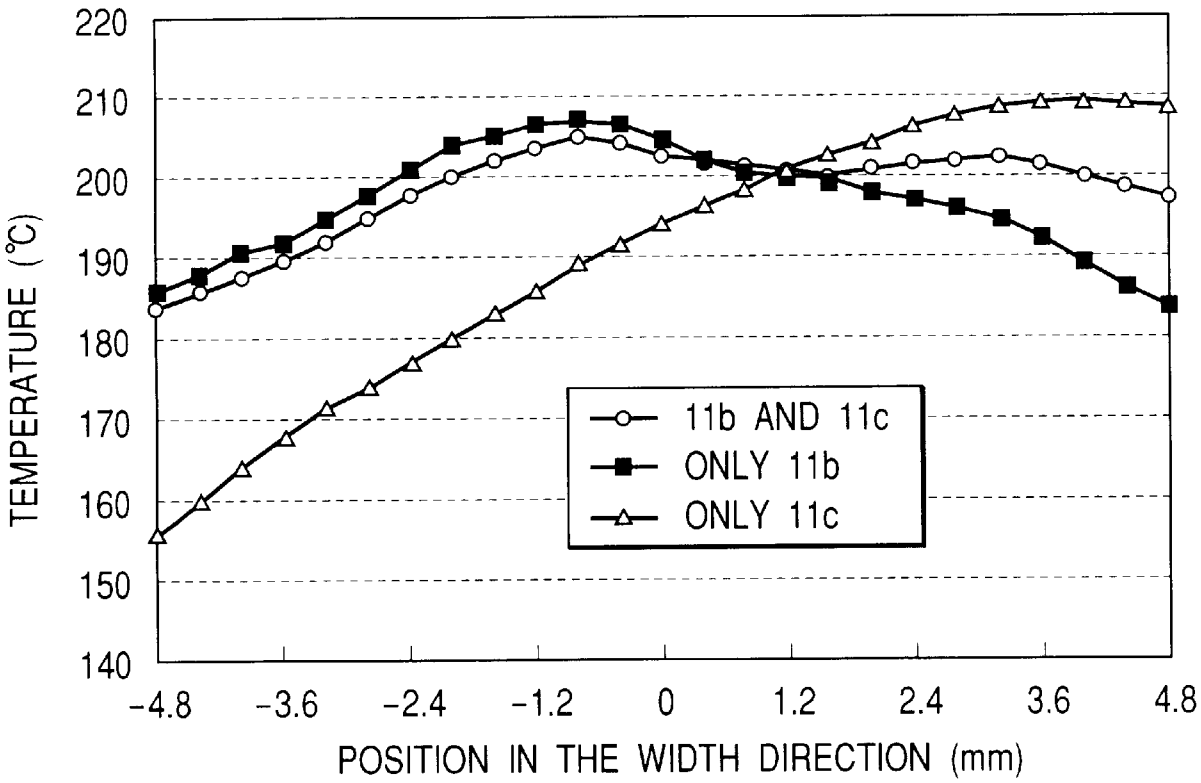
FIG. 13 is a graph showing a temperature distribution of a heater in a recording material conveying direction in the case in which a resistance layer to be energized is switched.

In addition, a temperature distribution in the width direction (recording material conveying direction) of the heater 11 was measured in the case in which an energizing pattern of the energizing heating resistance layers 11*b* and 11*c* was changed. Results of measurement are shown in FIG. 13. Further, on the horizontal axis, a negative side means an upstream side and a positive side means a downstream side with a nip center as 0. The thermistor 14 for temperature control is disposed in a position of 1.2 mm. From the figure, it is seen that, if only the energizing heating resistance layer 11*b* on the upstream side is energized and the case in which both the energizing heating resistance layers 11*b* and 11*c* are energized, a temperature distribution is substantially uniform over the width direction of the heater 11. The portions in the vicinity of the position where the thermistor is disposed also have a stable temperature. On the other hand, if only the energizing heating resistance layer 11*c* located on the downstream side is energized and heated, a temperature peak is in the downstream of the nip and a change of temperature is large in the vicinity of the position where the thermistor is disposed. In addition, when a fixing performance and a margin of high temperature offset were confirmed by varying adjusted temperature setting in each case, it was found that a margin was rarely obtained in the case in which only the energizing heating resistance layer 11*c* located on the downstream side is energized and heated. In view of the above, it is seen that if recording materials continuously conveyed are subjected to heat-fixing, the energizing heating resistance layer in which an energizing duty gradually falls, that is, the energizing heating resistance layer 11*c* is preferably formed on the downstream side in the heater in which a plurality of power supplying heating resistance layers are formed. This is due to the fact that a heat quantity generated in the heater 11 by the conveyance of the recording materials is flown to the downstream side. Thus, if the energizing heating resistance layer formed such that a heating amount at the end portion becomes large is disposed on the more downstream side of the direction of conveying a recording material than the other energizing heating resistance layer and the recording materials continuously conveyed are subjected to heat-fixing, it is preferable to gradually decrease an energizing duty of the energizing heating resistance layer having a large heating amount at the end portion.

Figure 7:
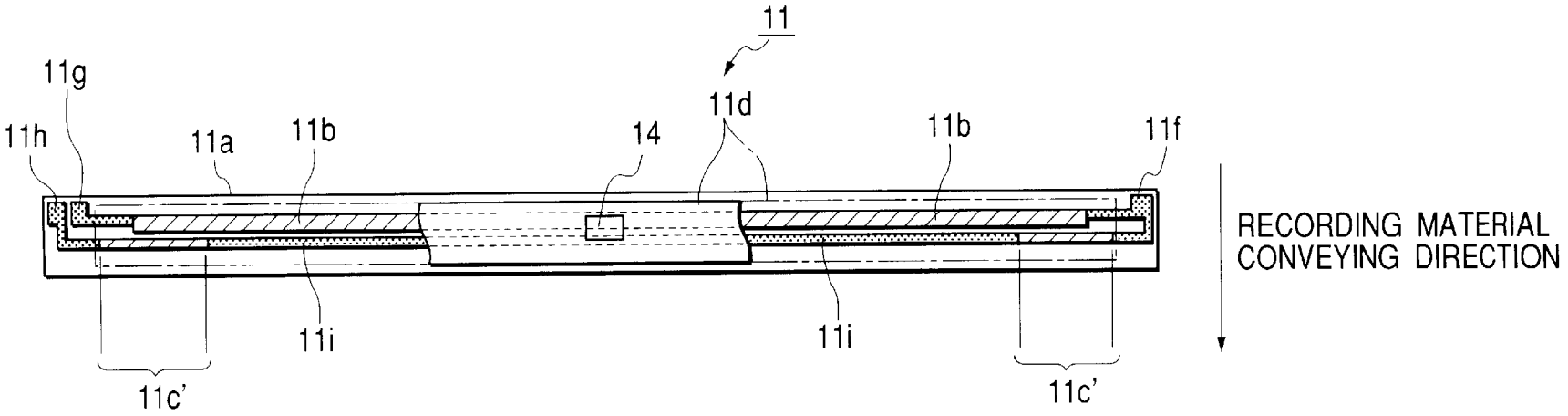
FIG. 7 is a schematic view (partially cut-off backside view) of an example of another structure of the heater.

In addition, as a structure of the heater 11, an energizing heating resistance layer 11*c*' in which at least one line heats only the end portion as shown in FIG. 7 can obtain the same effects. That is, in FIG. 7, the energizing heating resistance layer 11*c*', which is heated by energization between the electrodes for supplying power 11*f* and 11*h*, is provided only at both the end portion of the heater 11 and the parts between the energizing heating resistance layer 11*c*' at both the end portions are connected by a conductive portion 11*i*, whereby the energizing heating resistance layer 11*c*' in which only the both end portions are heated is formed.

A pattern of an energizing heating resistance layer may be any type as long as the energizing heating resistance layer is structured such that at least one line has a distribution of a heating amount by energizing it in the longitudinal direction of the heater and a heating amount increases at the end portion, has a control mode for making a heating amount at the end portion larger than the central portion over the longitudinal direction of the heater, and is structured to allow fluctuation of an energizing duty between the energizing heating resistance layer in which the heating amount at the end portion increases and at least another one line energizing heating resistance layer.

Figure 14:
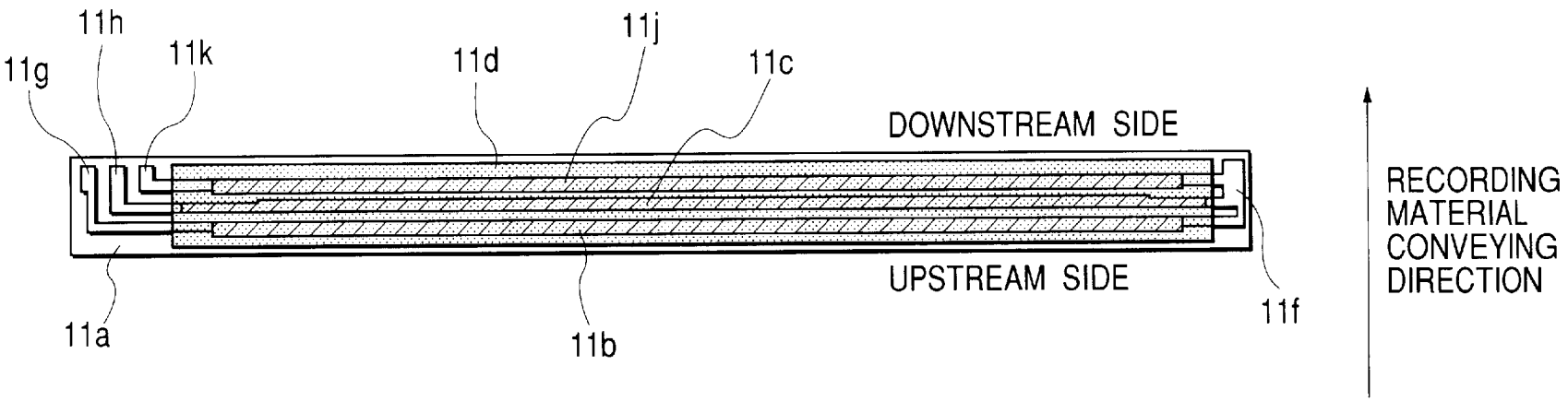
FIG. 14 is a diagram of another heater that can be applied to the present invention.

For example, as shown in FIG. 14, the heater 11 may have three line energizing heating resistance layer in which an energizing heating resistance layer 11*j* having a substantially uniform heating amount in the longitudinal direction may be added on the downstream side. In this case, heat is generated by energizing the energizing heating resistance layer 11*j* by energization between the electrode portions 11*k* and 11*f*. The energizing heating resistance layer 11*c*, which is formed to have a larger heating amount at the end portion, is sandwiched between the energizing heating resistance layers 11*b* and 11*c*. If a recording material is subjected to continuous heat-fixing using this heater, an energizing duty of the energizing heating resistance layer 11*c* is gradually decreased with respect to energizing duties of the energizing heating resistance layers 11*b* and 11*j*. Consequently, the same effects can be obtained. In addition, even if an energizing duty of the energizing heating resistance layer 11*c* falls, since the heater is heated by the energizing heating resistance layers 11*b* and 11*h* on its upstream and downstream sides, a temperature distribution in the recording material conveying direction of the heater becomes more stable.

In addition, although the description is made concerning the image forming apparatus for conveying a recording material on a central reference in this embodiment, an image forming apparatus having an end portion at one side as a recording material conveying reference can obtain the same effects by forming at least one line of an energizing heating resistance layer having a larger heating amount at an end portion opposite the reference side in the same manner.

<Second Embodiment>

A second embodiment of the present invention will be hereinafter described. An entire structure of an apparatus is the same as that shown in FIG. 1 described in the first embodiment and a structure inside the heat-fixing apparatus 6 is also the same as that shown in FIG. 2 described in the first embodiment. Since the width of the energizing heating resistance layer 11*c* is large, a temperature rising speed in the non-sheet passing area is high. Consequently, it is necessary to decrease the energizing duty of the energizing heating resistance layer 11*c* having a large heating amount at the end portion at an early stage.

An experiment described below was conducted in order to confirm the above description. Since an apparatus structure used in the experiment is the same as that described in the first embodiment, descriptions of the structure will be omitted.

The recording materials P used in the experiment were 500 cut sheets, respectively, widths of which were D1=216 mm, D2=210 mm and D3=184.2 mm, a thicknesses of the recording materials P were identical at 200 $\mu$m, and surfaces of the recording materials P were equally smooth.

In addition, three types of fluctuation method of an energizing duty were provided for the number of conveyed recording materials P. Experimental results in the case in which fluctuation of the energizing duty was changed are shown below.

In a column of end portion fixing performance of the table, ○ implies fixing performance without problem, Δ implies an allowable level and × implies inferior. In addition, in a column of an unusual temperature rising in a non-sheet passing area, ○ implies a temperature without problem, Δ implies an allowable temperature and × implies inferior.

Concerning the recording materials of the widths D1 and D2, printing was carried out at a speed of 34 sheets/minute. Concerning the recording material of the width D3, since an area where the energizing heating resistance layer sticks out is large and temperature rising in the non-sheet passing area is sharp, printing was carried out at the speed of 15 sheets/minutes.

The energizing duty in the table is shown as an energizing duty of the energizing heating resistance layer 11*c* in which an end portion heating amount is high with respect to the energizing duty of the energizing heating resistance layer 11*b* having an equal resistance value per unit length over the longitudinal direction as in the above-described first embodiment.

TABLE 2

(1) Fluctuation method A

| | Number of sheets fed | | | |
|---|---|---|---|---|
| | 1 to 40 sheets | 41 to 100 sheets | 101 to 200 sheets | 201 or more sheets |
| Energizing duty (11c/11b) | 20% | 20% | 20% | 20% |

A result of each recording material in the case in which the above-mentioned fluctuation of an energizing duty is carried out is shown below.

| | Width of a recording material | | |
|---|---|---|---|
| | D1 = 216 mm | D2 = 210 mm | D3 = 184.2 mm |
| End fixing performance at End Part | x | x | ○ |
| Unusual temperature rising at End Part | ○ | ○ | ○ |

(2) Fluctuation method B

| | Number of sheets fed | | | |
|---|---|---|---|---|
| | 1 to 40 sheets | 41 to 100 sheets | 101 to 200 sheets | 201 or more sheets |
| Energizing duty (11c/11b) | 120% | 80% | 50% | 20% |

A result of each recording material in the case in which the above-mentioned fluctuation of an energizing duty is carried out is shown below.

| | Width of a recording material | | |
|---|---|---|---|
| | D1 = 216 mm | D2 = 210 mm | D3 = 184.2 mm |
| End fixing performance at End Part | Δ | ○ | ○ |
| End unusual temperature rising at End Part | ○ | ○ | Δ |

(3) Fluctuation method C

| | Number of sheets fed | | | |
|---|---|---|---|---|
| | 1 to 40 sheets | 41 to 100 sheets | 101 to 200 sheets | 201 or more sheets |
| Energizing duty (11c/11b) | 150% | 120% | 80% | 50% |

A result of each recording material in the case in which the above-mentioned fluctuation of an energizing duty is carried out is shown below.

| | Width of a recording material | | |
|---|---|---|---|
| | D1 = 216 mm | D2 = 210 mm | D3 = 184.2 mm |
| Fixing performance at End Part | ○ | ○ | ○ |
| Unusual temperature rising at End Part | ○ | Δ | x |

As described above, it is seen that a fluctuation method of an energizing duty of the energizing heating resistance layer having a large heating amount at the end portion is optimized according to the width of the recording material P capable of being subjected to heat-fixing based on the experimental results, whereby optimized heat-fixing apparatus, which prevent defective end portion fixing and unusual temperature rising in the non-sheet passing area, can be applied to each recording material P.

In particular, it is more likely that favorable heat-fixing apparatus are attained if an energizing duty of the energizing heating resistance layer 11*c*, which has a larger heating amount at the end portion as the width of the recording material P is larger, is changed at a high level.

The above description is made concerning a method of optimizing an energizing duty paying attention to the width of the recording material P in this embodiment. However, for example, it is means for providing a satisfactory image and extending a durable life of an apparatus to optimize a fluctuation method of an energizing duty of an energizing heating resistance layer having a different heat distribution in the longitudinal direction according to parameters such as the surface property and thickness of the recording material P.

In particular, in case of a recording material with satisfactory surface property (small surface roughness), since heat tends to be transmitted to the recording material P in the nip portion N of the heat-fixing apparatus 6, consumption power of the heater 11 becomes large. On the other hand, since the surface property becomes satisfactory, fixing performance is satisfactory. Thus, even if the energizing duty of the energizing heating resistance layer 11*c* having a large heating amount at the end portion is reduced, it is possible to satisfy the end portion fixing performance of the recording material P and it is possible to control temperature rising in the non-sheet passing area.

<Third Embodiment>

A third embodiment will be hereinafter described. Since an entire structure of an apparatus is the same as that shown in FIG. 1 described in the first embodiment and the structure inside the heat-fixing apparatus 6 are the same as those shown in FIG. 2 described in the first embodiment, repeated descriptions will be omitted.

In this embodiment, a heat releasing member for preventing unusual temperature rising at both the end portions of the heater 11 is provided.

Figure 8:
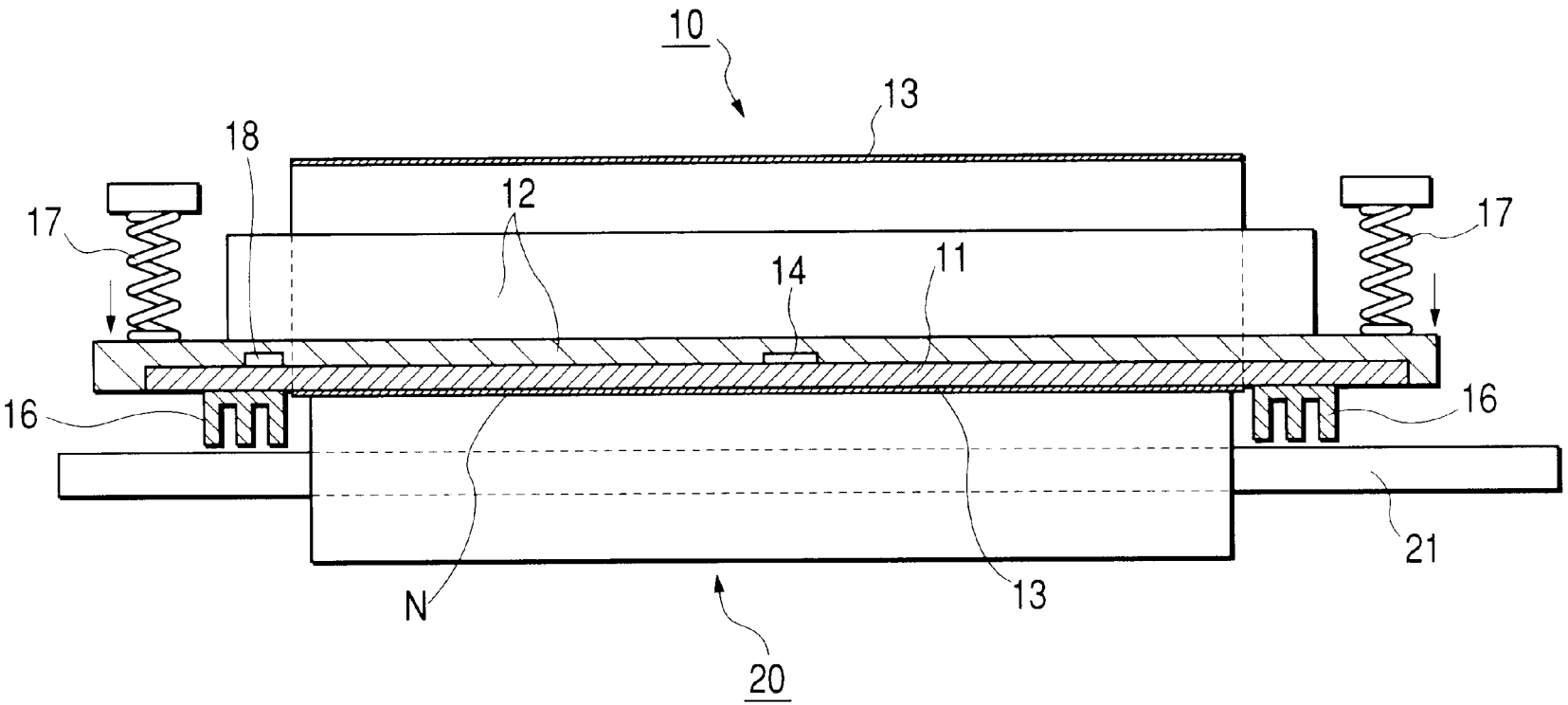
FIG. 8 is a schematic diagram (schematic vertical sectional view) of a heat-fixing apparatus in a third embodiment.
Figure 9:
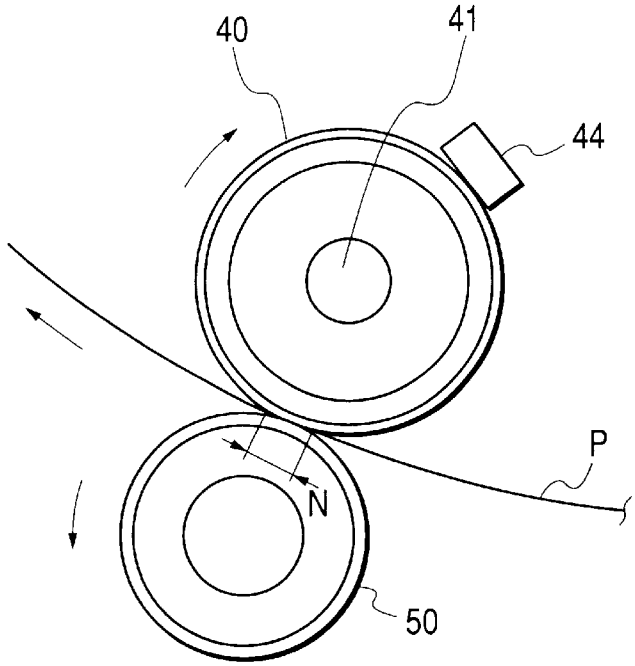
FIG. 9 is a schematic diagram of a heat-fixing apparatus (heat roller system) of a conventional example.

A structure of a cross section in a longitudinal direction of this embodiment will be described with reference to FIG. 8. In the figure, reference numeral 16 denotes a heat releasing member for releasing excess overheat by contacting the end portion of the heater 11. The heat releasing member 16 is formed of a metal member, a ceramic member or the like having good thermal conductivity, is usually spaced from the heater 11 and is caused to abut the heater 11 at a predetermined pressure such that it is closely adhered to the end portion of the heater 11 by a switching element or the like such as a not-shown electric clutch when a temperature of end portion temperature detecting means 18 reaches a predetermined temperature or more.

Even if energizing duties of the energizing heating resistance layers 11*b* and 11*c* of the heater 11 are optimized by the methods of the first embodiment and the second embodiment, if large consumption power is required such as the case in which a temperature of the recording material P capable of being subjected to heat-fixing is extremely low, there arises a limit in reducing the energizing duty of the energizing heating resistance layer 11*c* in which a heating amount at the end portion of the heater 11 is larger than that in the central portion.

That is, since fluctuation of an electric current at the temperature adjusting control such as wave number control and phase control becomes large and problems such as flicker and harmonic distortion occur if a resistance value of the energizing heating resistance layer is made too small, it is necessary to reduce power to some extent.

In such a case, if an energizing duty of energizing heating resistance layer of one line is decreased too much, power becomes insufficient and temperature control becomes impossible.

Thus, in such a case, the energizing heating resistance layer 11*c* having a large heating amount at the end portion of the heater 11 must be energized to some extent. In such a case, it is not possible any more to prevent unusual temperature rising in a non-sheet passing area by the structures and the energizing duties of the energizing heating resistance layers 11*b* and 11*c* of the heater 11.

Therefore, as described in this embodiment, if a predetermined temperature is sensed by the end portion temperature sensing means 18, the heat releasing member 16 is caused to abut the end portion of the heater 11 directly to release heat, thereby preventing unusual temperature rising.

In each of the above-mentioned embodiments, the heater 11 is the backside heating type and the energizing heating resistance layers 11*b* and 11*c* are formed on the opposite side of the fixing nip portion N with respect to the substrate 11*a*. However, the heater 11 may be a surface heating type and the energizing heating resistance layers 11*b* and 11*c* may be formed on the fixing nip portion N side with respect to the substrate 11*a*.

In the present invention, for example, an image heating apparatus for heating a recording material bearing an image to reform surface property such as luster, an image heating apparatus for applying provisional fixing processing, a heating apparatus for drying used in an ink jet printer and the like are included in the category of the heat-fixing apparatus.

Thus, it is seen that an image heating apparatus is provided. One skilled in the art will appreciate that the present invention can be practiced by other than the preferred embodiment which is presented for the purposes of illustration and not of limitation, and the present invention can be modified in any way within the scope of the present invention.

What is claimed is:

1. An image heating apparatus for heating an image formed on a recording material, comprising:

a heating member;

a first heat generating element mounted on said heating member; and a second heat generating element mounted on said heating member, said second heat generating element having a resistance value per unit length at an end portion thereof which is larger than that at an end portion of said first heat generating element, and power supply control means for controlling an electrical power supply to said first heat generating element and said second heat generating element, wherein said first heat generating element is located on an upstream side of said second heat generating element in a moving direction of the recording material; and said control means gradually decreasing an energizing duty of said second heat generating element with respect to said first heat generating element at the time when a plurality of sheets of the recording material are continuously heated.

2. An image heating apparatus for heating an image formed on a recording material, comprising:

a heating member;

a first heat generating element mounted on said heating member; and a second heat generating element mounted on said heating member, said second heat generating element having a resistance value per unit length at an end portion thereof which is larger than that at an end portion of said first heat generating element; and power supply control means for controlling an electrical power supply to said first heat generating element and said second heat generating element, wherein said first heat generating element is located on an upstream side of said second heat generating element in a moving direction of the recording material, wherein said control means sets an energizing duty of said first heat generating element and said second heat generating element in accordance with a size of the recording material, and wherein said control means increases the energizing duty of said second heat generating element more as a size of the recording material becomes larger.

3. An image heating apparatus for heating an image formed on a recording material, comprising:

a heating member;

a first heat generating element mounted on said heating member, and a second heat generating element mounted on said heating member, said second heat generating element having a resistance value per unit length at an end portion thereof which is larger than that at an end portion of said first heat generating element; and power supply control means for controlling an electrical power supply to said first heat generating element and said second heat generating element, wherein said first heat generating element is located on an upstream side of said second heat generating element in a moving direction of the recording material, wherein said control means sets an energizing duty of said first heat generating element and said second heat generating element in accordance with a surface roughness of the recording material, and wherein said control means increases the energizing duty of said second heat generating element more as a surface roughness of the recording material becomes larger.

4. An image heating for heating an image formed on a recording material, comprising:

a heating member;

a first heat generating element mounted on said heating member; and a second heat generating element mounted on said heating member, said second heat generating element having a resistance value per unit length at an end portion thereof which is larger than that at an end portion of said first heat generating element; and power supply control means for controlling an electrical power supply to said first heat generating element and said second heat generating element, wherein said first heat generating element is located on an upstream side of said second heat generating element in a moving direction of the recording material, wherein said control means sets an energizing duty of said first heat generating element and said second heat generating element in accordance with a thickness of the recording material, and wherein said control means increases the energizing duty of said second heat generating element more as a thickness of the recording material becomes thinner.

5. An image heating apparatus for heating an image formed on a recording material, comprising:

a heating member;

a first heat generating element mounted on said heating member; and a second heat generating element mounted on said heating member, said second heat generating element having a resistance value per unit length at an end portion thereof which is larger than that at an end portion of said first heat generating element, and wherein said first heat generating element is located on an upstream side of said second heat generating element in a moving direction of the recording material, and wherein said second heat generating element is longer than said first heat generating element.

6. An image heating apparatus as in any one of claims 1 or 2–5, wherein said first heat generating element and said second heat generating element are provided on an opposite surface side to a surface opposing the recording material of said heating member.

7. An image heating apparatus as in any one of claims 1 or 2–5, wherein said apparatus further comprises a film moving while contacting said heating member, and said heating member heats the image through said film.

8. An image heating apparatus for heating an image formed on a recording material, comprising:

a heating member;

a first heat generating element mounted on said heating member, said first heat generating element having a resistance value per unit length which is substantially uniform in a longitudinal direction;

a second heat generating element mounted on said heating member, said second heat generating element having a resistance value per unit length which is nonuniform in the longitudinal direction; and power supply control means for controlling an electrical power supply to said first heat generating element and said second heat generating element, wherein said first heat generating element is located on an upstream side of said second heat generating element in a moving direction of the recording material and said control means gradually decreases an energizing duty of said second heat generating element with respect to said first heat generating element at the time when a plurality of sheets of the recording material are continuously heated.

9. An image heating apparatus for heating an image formed on a recording material, comprising:

a heating member;

a first heat generating element mounted on said heating member, said first heat generating element having a resistance value per unit length which is substantially uniform in a longitudinal direction;

a second heat generating element mounted on said heating member, said second heat generating element having a resistance value per unit length which is nonuniform in the longitudinal direction, and, power supply control means for controlling an electrical power supply to said first heat generating element and said second heat generating element, wherein said first heat generating element is located on an upstream side of said second heat generating element in a moving direction of the recording material and wherein said control means setting an energizing duty of said first heat generating element and said second heat generating element in accordance with a size of the recording material, and wherein said control means increases the energizing duty of said second heat generating element more as a size of the recording material becomes larger.

10. An image heating apparatus for heating an image formed on a recording material, comprising:

a heating member;

a first heat generating element mounted on said heating member, said first heat generating element having a resistance value per unit length which is substantially uniform in a longitudinal direction;

a second heat generating element mounted on said heating member, said second heat generating element having a resistance value per unit length which is nonuniform in the longitudinal direction, and power supply control means for controlling an electrical power supply to said first heat generating element and said second heat generating element, wherein said first heat generating element is located on an upstream side of said second heat generating element in a moving direction of the recording material, wherein said control means sets an energizing duty of said first heat generating element and said second heat generating element in accordance with a surface roughness of the recording material, and wherein said control means increases the energizing duty of said second heat generating element more as a surface roughness of the recording material becomes larger.

11. An image heating apparatus for heating an image formed on a recording material, comprising:

a heating member;

a first heat generating element mounted on said heating member, said first heat generating element having a resistance value per unit length which is substantially uniform in a longitudinal direction;

a second heat generating element mounted on said heating member, said second heat generating element having a resistance value per unit length which is nonuniform in the longitudinal direction, and power supply control means for controlling an electrical power supply to said first heat generating element and said second heat generating element, wherein said first heat generating element is located on an upstream side of said second heat generating element in a moving direction of the recording material, wherein said control means sets an energizing duty of said first heat generating element and said second heat generating element in accordance with a thickness of the recording material, and wherein said control means increases the energizing duty of said second heat generating element more as the thickness of the recording material becomes thinner.

12. An image heating apparatus for heating an image formed on a recording material, comprising:

a heating member;

a first heat generating element mounted on said heating member, said first heat generating element having a resistance value per unit length which is substantially uniform in a longitudinal direction; and a second heat generating element mounted on said heating member, said second heat generating element having a resistance value per unit length which is nonuniform in the longitudinal direction, wherein said first heat generating element is located on an upstream side of said second heat generating element in a moving direction of the recording material, and wherein said second heat generating element is longer than said first heat generating element.

13. An image heating apparatus for heating an image formed on a recording material, comprising:

a heating member;

a first heat generating element mounted on said heating member, said first heat generating element having a resistance value per unit length which is substantially uniform in a longitudinal direction;

a second heat generating element mounted on said heating member, said second heat generating element having a resistance value per unit length which is nonuniform in the longitudinal direction, and wherein said first heat generating element is located on an upstream side of said second heat generating element in a moving direction of the recording material, and wherein said second heat generating element has a resistance value per unit length higher at an end portion thereof than at a central portion thereof.

14. An image heating apparatus as in any one of claims 8 or 9–13, wherein said first heat generating element and said second heat generating element are provided on an opposite surface side to a surface opposing the recording material of said heating member.

15. An image heating apparatus as in any one of claims 8 or 9–13, wherein said apparatus further comprises a film moving while contacting said heating member, and said heating member heats the image through said film.

16. An image heating apparatus for heating an image formed on a recording material, comprising:

a heating member;

a first heat generating element mounted on said heating member; and a second heat generating element mounted on said heating member, said second heat generating element being longer than said first heat generating element, wherein said first heat generating element is located on an upstream side of said second heat generating element in a moving direction of the recording material.

17. An image heating apparatus according to claim 16, further comprising a power supply control means for controlling an electrical power supply to said first heat generating element and said second heat generating element, said control means gradually decreasing an energizing duty of said second heat generating element with respect to said first heat generating element at the time when a plurality of sheets of the recording material are continuously heated.

18. An image heating apparatus according to claim 16, further comprising a power supply control means for controlling an electrical power supply to said first heat generating element and said second heat generating element, said control means setting an energizing duty of said first heat generating element and said second heat generating element n accordance with a type of the recording material.

19. An image heating apparatus according to claim 18, wherein said control means increases the energizing duty of said second heat generating element more as a size of the recording material becomes larger.

20. An image heating apparatus according to claim 18, wherein said control means increases the energizing duty of said second heat generating element more as a surface roughness of the recording material becomes larger.

21. An image heating apparatus according to claim 18, wherein said control means increases the energizing duty of said second heat generating element more as a thickness of the recording material becomes thinner.

22. An image heating apparatus according to claim 16, wherein said second heat generating element has a resistance value per unit length higher at an end portion thereof than at a central portion thereof.

23. An image heating apparatus according to claim 16, wherein said first heat generating element and said second heat generating element are provided on an opposite surface side to a surface opposing the recording material of said heating member.

24. An image heating apparatus according to claim 16, wherein said apparatus further comprises a film moving while contacting said heating member, and said heating member heats the image through said film.

* * * * *

UNITED STATES PATENT AND TRADEMARK OFFICE

CERTIFICATE OF CORRECTION

PATENT NO. : 6,713,725 B2
DATED : March 30, 2004
INVENTOR(S) : Satoru Izawa et al.

It is certified that error appears in the above-identified patent and that said Letters Patent is hereby corrected as shown below:

Title page,
Item [56], References Cited, FOREIGN PATENT DOCUMENTS, "2000077168" should read -- 2000-077168 --; and "2001194936" should read -- 2001-194936 --.

Column 12,
Line 18, "portion" should read -- portions --.
Line 36, "layer" should read -- layers --.

Column 17,
Line 27, "member," should read -- member; --.

Column 18,
Line 62, "direction," should read -- direction --; and "and," should read -- and --.

Column 19,
Lines 20 and 46, "direction," should read -- direction; --.

Column 20,
Line 63, "n" should read -- in --.

Signed and Sealed this

Tenth Day of August, 2004

JON W. DUDAS
*Acting Director of the United States Patent and Trademark Office*